US007811125B2

(12) United States Patent
Kretz et al.

(10) Patent No.: US 7,811,125 B2
(45) Date of Patent: Oct. 12, 2010

(54) COAXIAL CONNECTING ELEMENT FOR THE MICROWAVE BAND AS WELL AS A METHOD FOR ITS PRODUCTION

(75) Inventors: Adjan Kretz, St. Gallen (CH); Josef Fuchs, Appenzell (CH); Yann Blavette, Mandray (FR)

(73) Assignee: Huber + Suhner AG, Herisau (CH)

( * ) Notice: Subject to any disclaimer, the term of this patent is extended or adjusted under 35 U.S.C. 154(b) by 23 days.

(21) Appl. No.: 12/439,953

(22) PCT Filed: Jul. 31, 2007

(86) PCT No.: PCT/CH2007/000376

§ 371 (c)(1),
(2), (4) Date: Mar. 4, 2009

(87) PCT Pub. No.: WO2008/031240

PCT Pub. Date: Mar. 20, 2008

(65) Prior Publication Data

US 2010/0029130 A1 Feb. 4, 2010

(30) Foreign Application Priority Data

Sep. 13, 2006 (CH) ..... 1465/06

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS

| | | | | |
|---|---|---|---|---|
| 4,456,324 | A | 6/1984 | Staeger | |
| 4,718,864 | A | 1/1988 | Flanagan | |
| 4,867,703 | A | 9/1989 | Flanagan et al. | |
| 4,981,445 | A | 1/1991 | Bacher et al. | |
| 5,167,532 | A * | 12/1992 | Bruno et al. | 439/578 |
| 5,269,702 | A | 12/1993 | Bacher et al. | |
| 6,893,290 | B2 * | 5/2005 | Buenz et al. | 439/578 |

OTHER PUBLICATIONS

R. Fuks, "New Dielectric Bead for Millimeter-wave Coaxial Components", Microwave Journal, (2001).

* cited by examiner

*Primary Examiner*—Michael C Zarroli
(74) *Attorney, Agent, or Firm*—The Webb Law Firm

(57) ABSTRACT

A coaxial connecting element for the microwave range comprises a preferably bar-shaped inner conductor, which extends along an axis and is held concentrically in an outer conductor by means of at least one dielectric supporting element, wherein the outer conductor has a plurality of radial slots extending in the axial direction distributed around the circumference in the region of the at least one supporting element.

18 Claims, 3 Drawing Sheets

COAXIAL CONNECTING ELEMENT FOR THE MICROWAVE BAND AS WELL AS A METHOD FOR ITS PRODUCTION

BACKGROUND OF THE INVENTION

1. Field of the Invention

The present invention relates to the field of microwave engineering. The invention relates in particular to a coaxial connecting element for the microwave band and to a method for producing a connecting element such as this.

2. Description of Related Art

Coaxial components and connecting elements for the microwave band (from several GHz up to 250 GHz) generally have an outer conductor which extends along an axis and in which an inner conductor is arranged and held concentrically. One or more dielectric supporting element or elements is or are used for holding the inner conductor in the outer conductor. The configuration and the installation of the supporting elements influence not only the electrical but also the mechanical characteristics of the coaxial connecting element. On the one hand, the supporting elements should have as little influence as possible, in comparison with the air-cored line that is used as a reference, on wave propagation in the connecting element. On the other hand, the mechanical retention must be designed to be sufficiently permanent and precise that a large number of connecting cycles can be carried out with constant accuracy.

Examples of supporting elements such as these are disclosed, for example, in the documents U.S. Pat. No. 4,718,864, U.S. Pat. No. 4,867,703 or U.S. Pat. No. 5,269,702. The technology of hermetically sealed glass bushings is also known, in which an inner conductor is held by means of glass in a concentric metal ring, with the glass filling the annular space between the metal ring and the inner conductor, and being introduced by means of a melting process.

Another problem caused by the supporting elements is that higher transverse modes (in particular $TE_{11}$) are stimulated in the area of the supporting elements, which leads to distortion of the transmitted signals and limits the range of operation of the connecting element in the direction of lower frequencies.

The article by R. Fuks, "New Dielectric Bead for Millimeter-wave Coaxial Components", Microwave Journal No. 5, p. 318 ff (2001) explains this problem and, in order to solve it, proposes a novel type of supporting elements which is completely symmetrical on the radial plane and has inclined surfaces with respect to the axis. However, the supporting elements are produced as separate components and are then fitted, and this is at the expense of the precision of the arrangement.

Another way to hold the inner conductor in the outer conductor has been proposed in the document U.S. Pat. No. 4,456,324. In this known solution, the inner conductor is centred by and held by four curved dielectric platelets, which are held in a slotted hollow cylinder of the outer conductor and form the configuration of a Maltese cross, through whose centre the inner conductor passes. This type of retention has the advantage that only a very small amount of dielectric material need be used for support purposes. However, one considerable disadvantage is the complicated and complex assembly of the arrangement, which leads to considerable difficulties, especially in the case of coaxial arrangements with diameters in the millimetre range. Furthermore, the desired accuracies can be achieved only with difficulty because it is assembled from a large number of individual parts. The slots in the outer conductor are used to hold the dielectric platelets. No other function is recognized for them.

SUMMARY OF THE INVENTION

The object of the invention is to provide a coaxial connecting element for the microwave band, which avoids the disadvantages of known solutions and is distinguished, with high precision and good mechanical robustness at the same time, by simplified installation and excellent electrical characteristics, and to specify a method for producing a connecting element such as this.

The essence of the invention is to form the supporting element integrally and, in particular, to mould it integrally or to spray it directly onto the outer conductor. This results in good mechanical robustness with high precision and simplified production and assembly at the same time, without having to accept any deterioration in the electrical characteristics.

According to one preferred embodiment of the invention, the supporting element is formed integrally, in particular moulded, on the outer conductor, in which case preferably the supporting element is non-detachably connected to the outer conductor.

Another embodiment is distinguished in that the outer conductor has a housing in which an essentially hollow-cylindrical insert is arranged and held concentrically, in that the supporting element is formed integrally on the insert and in that the slots are arranged in the insert, in which case, in particular, the supporting element fills the slots in the insert in the circumferential direction, in order to fix the supporting element on the insert.

A further embodiment is characterized in that the insert has an annular groove on the outside, and in that the supporting element fills the annular groove in the axial direction, in order to fix the supporting element on the insert.

The housing of the outer conductor preferably has two housing parts which are arranged one behind the other in the axial direction, can be screwed to one another, hold the insert with the integrally formed supporting element and fix it in the axial direction, in which case an axial through-hole is provided respectively in the two housing parts, through which the inner conductor runs, and in that both through-holes have a step on which the insert together with the integrally formed supporting element is supported in the axial direction.

In particular, the insert has a third through-hole, and the internal diameters of the three through-holes are the same.

According to another embodiment of the invention, the supporting element is arranged in the centre area of the connecting element seen in the axial direction.

A further embodiment is characterized in that the supporting element has two hollow cylinders which are arranged concentrically in one another and are connected to one another preferably by radial webs, with the inner hollow cylinder holding the inner conductor and with the outer hollow cylinder being connected to the insert, and in that the preferably radial webs are formed by walls of blind holes which extend into the supporting element between the two hollow cylinders preferably in the axial direction and alternately from both sides. In particular, the blind holes taper towards the base, in which case in the area of the supporting element the inner conductor has a section which holds the inner hollow cylinder of the supporting element fixing it in the axial direction and/or securing it against rotation about the axis. This section may be knurled or may have a groove (round, triangular or polygonal), or some other shape which is suitable for fixing.

According to a further embodiment, two or more slots (26) are provided, distributed uniformly over the circumference of the outer conductor of the insert.

The supporting element (15) is preferably composed of a liquid-crystal polymer (LCP) or a thermoplastic PTFE.

One preferred embodiment of the method according to the invention is characterized in that the outer conductor has a housing in which an essentially hollow cylindrical insert is arranged and held concentrically, in that the supporting element is moulded onto the insert and in that the insert, together with the moulded-on supporting element, is installed in the housing.

BRIEF DESCRIPTION OF THE DRAWINGS

The invention will be explained in more detail in the following text with reference to exemplary embodiments and in conjunction with the drawing, in which.

DETAILED DESCRIPTION OF THE PRESENT INVENTION

Figure 1:
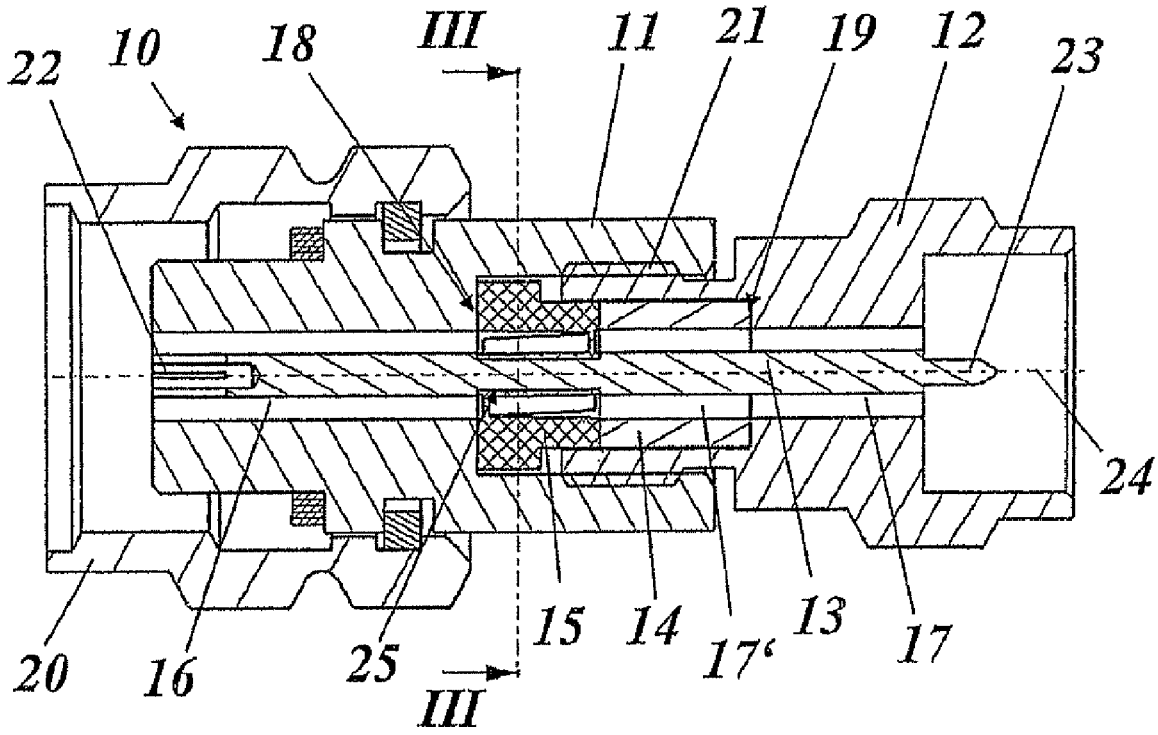
FIG. 1 shows a longitudinal section through a coaxial connecting element according to one preferred exemplary embodiment of the invention.
Figure 2:
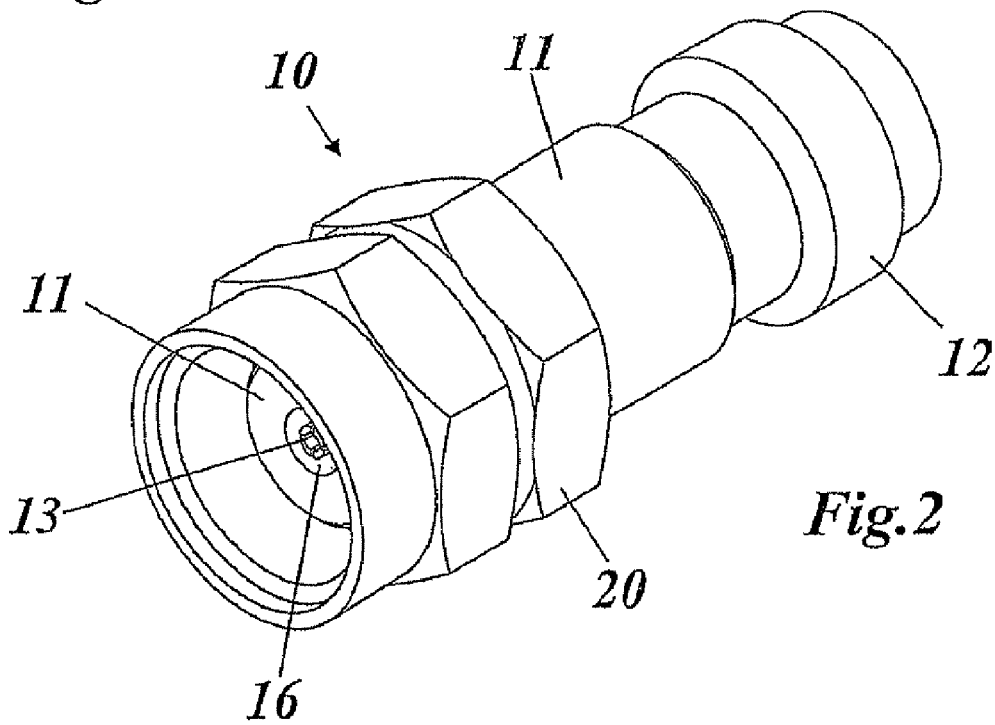
FIG. 2 shows a perspective side view of the connecting element of FIG. 1.
Figure 3:
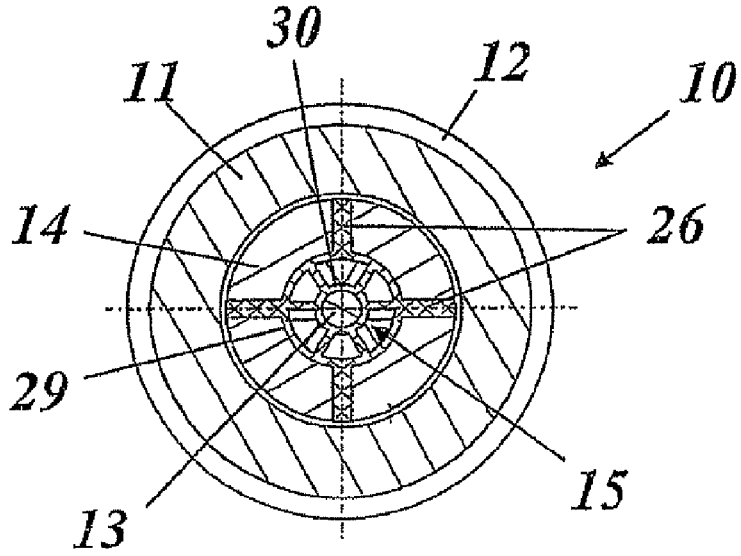
FIG. 3 shows a cross section through the connecting element from FIG. 1, on the plane III-III shown there.

FIG. 1 shows a longitudinal section through a coaxial connecting element according to one preferred exemplary embodiment of the invention. The coaxial connecting element 10, which may be a cable connector for example, has a housing which is composed of two cylindrical, metallic housing parts 11, 12, extends along an axis 24 and, together with a cylindrical insert 14 accommodated in the housing, forms the outer conductor of the connecting element 10. The two housing parts 11, 12, can be screwed to one another by means of a screw thread 21. The two housing parts 11, 12 and the metallic insert 14 each have a central through-hole 16, 17 and 17', respectively, with the same internal diameter which, when the connecting element 10 has been assembled, complement one another to form one through-hole 16, 17, 17' which passes through the entire connecting element 10. However, it is also feasible for these through-holes 16, 17, 17' to have different diameters and thus to provide matching between different connector types. The insert 14, on which a dielectric supporting element 15 is integrally formed in order to hold a concentric inner conductor 13, is housed between two steps 18 and 19 in the through-holes 16 and 17 in the two housing parts 11, 12. The inner conductor 13 is mounted in the supporting element 15 and extends, at a sufficient distance from the wall, through the through-hole 16, 17, 17'. By way of example, it is in the form of a metallic pin which ends at one end in a slotted bush 22 and at the other end in a plug pin 23. Other configurations of the inner conductor 13 are, however, also feasible within the scope of the invention. This also applies to the configuration of the housing 11, 12. In the exemplary embodiment shown in FIG. 1, a union nut 20 is provided at the left-hand end, which can be rotated with respect to the housing 11, 12 and allows the connecting element to be detachably connected to an appropriately designed connecting part. The external view of the connecting element 10 from FIG. 1 is reproduced in FIG. 2 in the form of a cross-section on the plane III-III passing through the supporting element 15 in FIG. 3.

The connecting element 10 is intended for use at frequencies in the two-digit to three-digit GHz range. On the one hand, the precision and mechanical robustness with which the inner conductor 13, which has an external diameter of <1 mm, is mounted in the outer conductor 11, 12, 14, are therefore particularly important. On the other hand, the excitation of undesirable modes, in particular TE11 mode, in the area of the supporting element 15 must be suppressed as much as possible in order to ensure that the connecting element has optimum transmission characteristics. Finally, the production and assembly should be sufficiently simple that even relatively large quantities can be produced with high quality and at acceptable costs.

Figure 4:
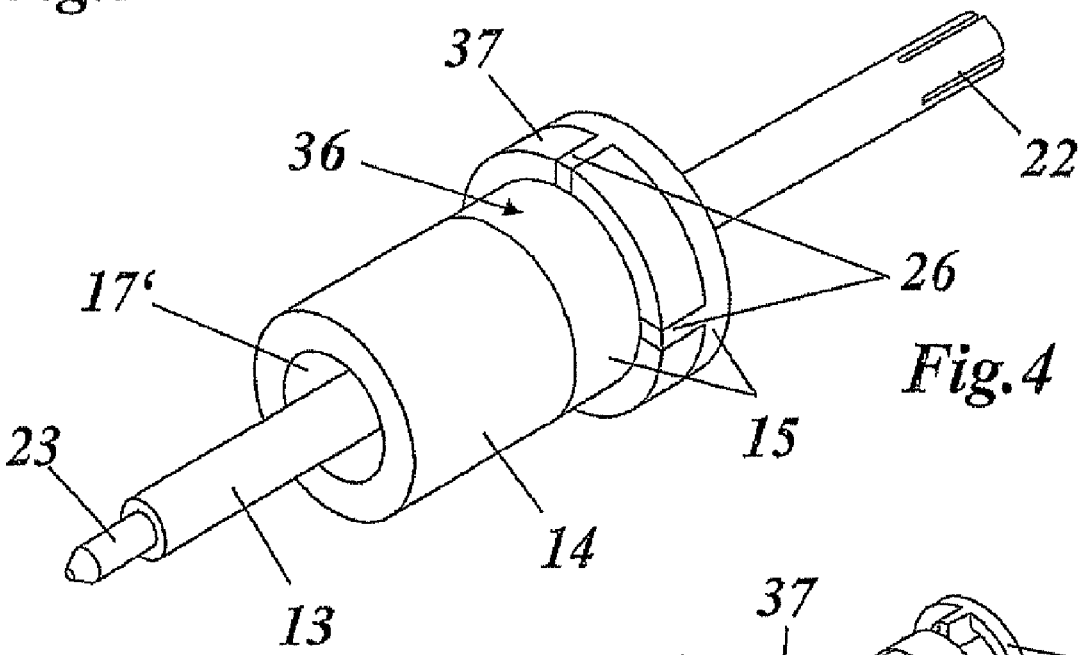
FIG. 4 shows a perspective side view of the insert with a moulded supporting element and inner conductor from FIG. 1.
Figure 5:
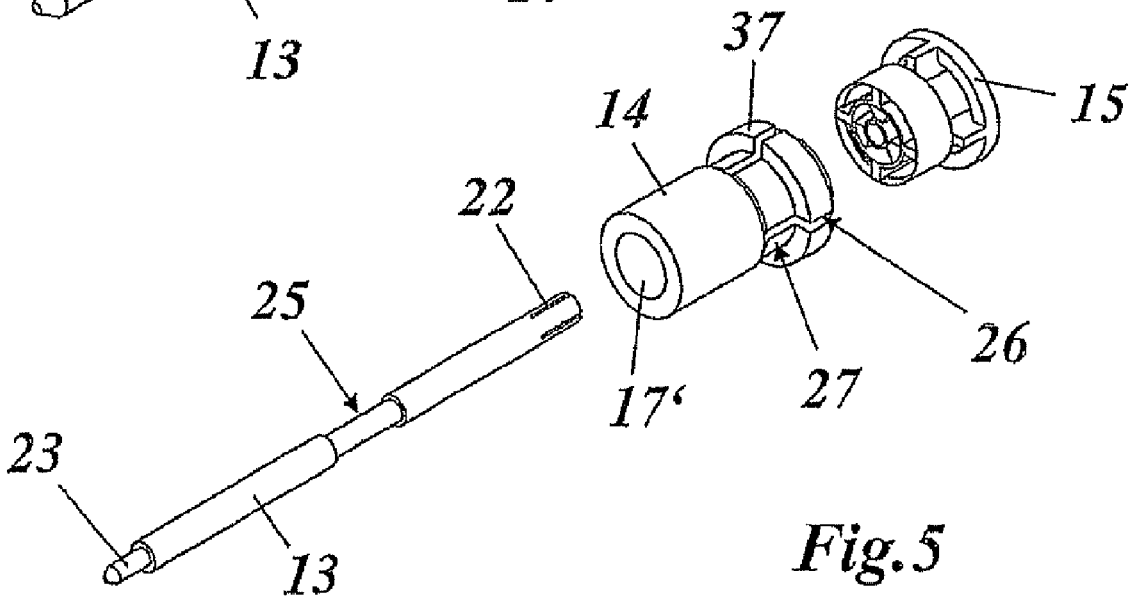
FIG. 5 shows an exploded illustration of the individual elements of the configuration from FIG. 4.
Figure 6:
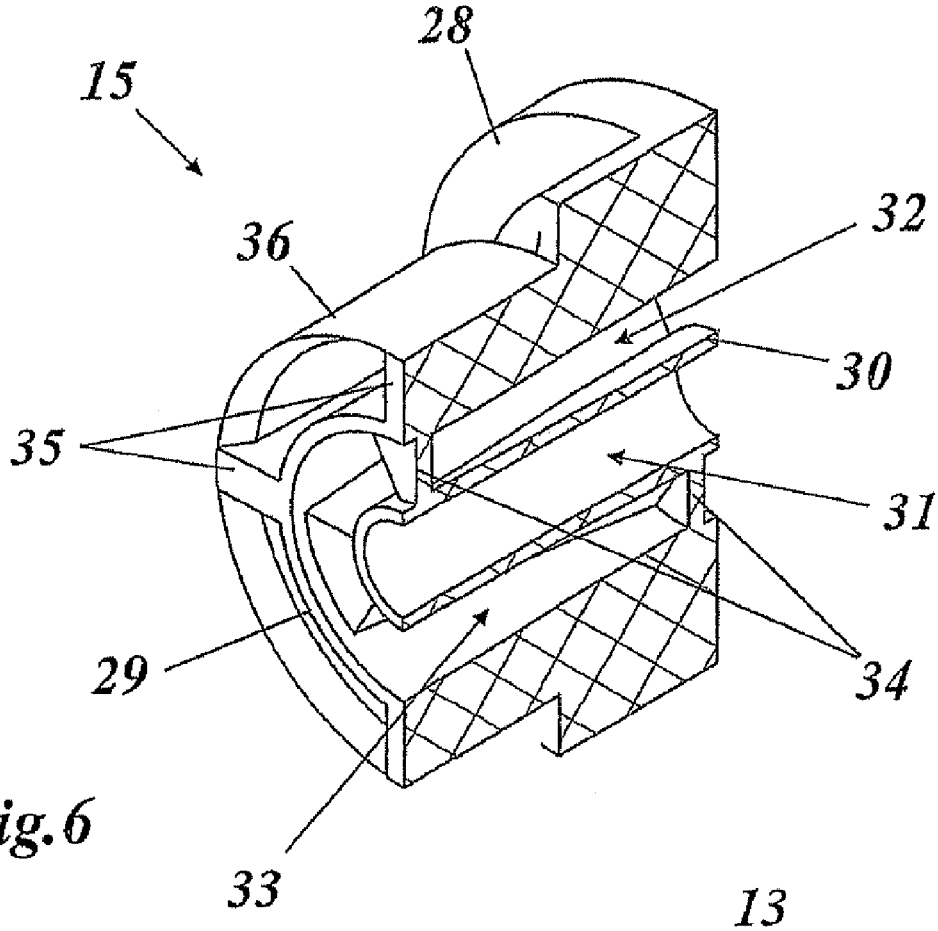
FIG. 6 shows a perspective illustration of a longitudinal section through the supporting element from FIG. 5.
Figure 7:
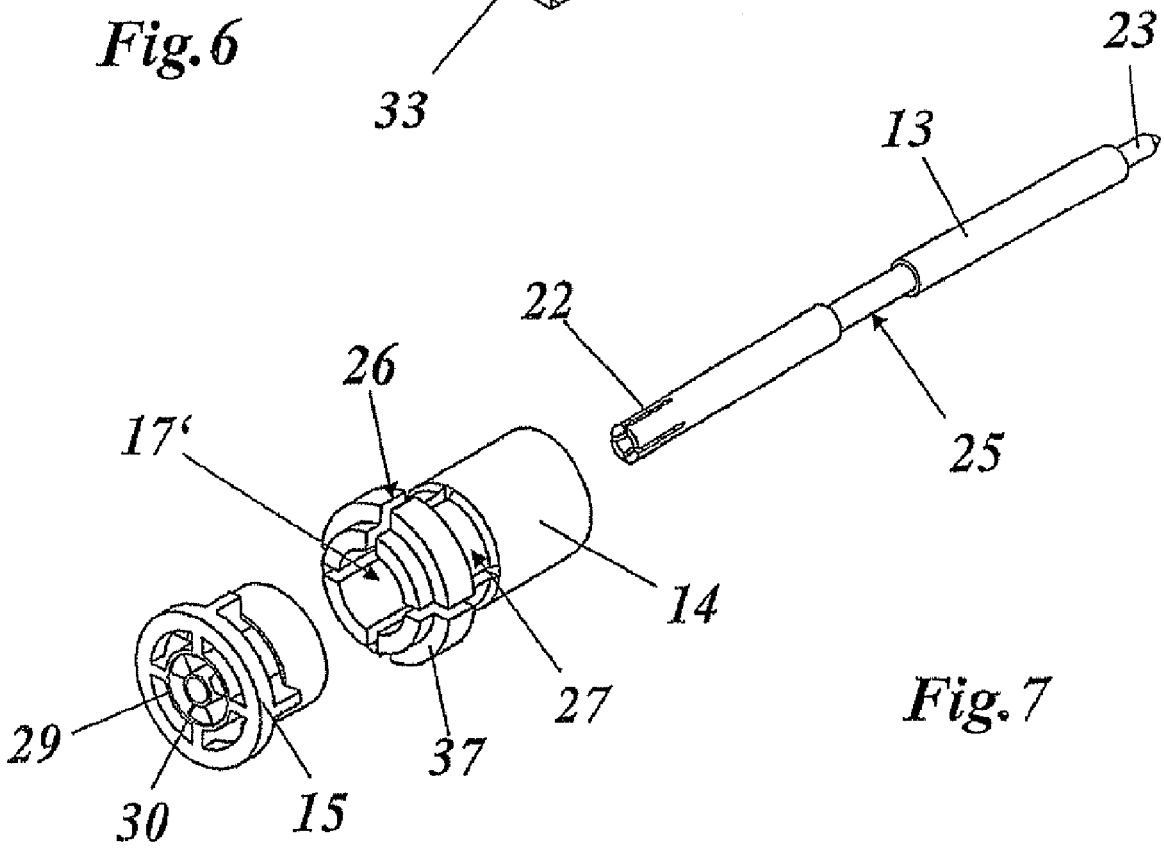
FIG. 7 shows an illustration, comparable to FIG. 5 of the individual elements, looking from the opposite direction.

This is achieved by integrally forming or moulding the supporting element 15 on the insert shown separately in FIGS. 5 and 7, and the arrangement of in particular radial slots 26 which preferably extend in the axial direction, on the circumference of the insert 14 in the area of the supporting element 15. In the example shown in FIGS. 1-7, four slots 26 are provided, each offset by 90°. However, it is also possible to provide only two slots, offset by 180°, three slots or more than four slots. When the supporting element 15 is moulded on, the slots 26 can, at the same time, be used as channels to pass on the injected material, and can be filled with the material of the supporting element 15 during the moulding process (see for example FIG. 4). The slots 26 interrupt the ring currents that occur in the TE11 mode on the outer conductor, and therefore prevent the excitation of this mode.

In order to mould the supporting element 15, the insert 14 is inserted into an appropriate mould, giving the supporting element 15 the shape illustrated in FIG. 6. The inner conductor 30 can also be included in the moulding process. However, it is also possible not to mount the inner conductor 13 in the supporting element 15 until later. The cylindrical supporting element 15 has an inner hollow cylinder 30 with a through-opening 31, and an outer hollow cylinder 29, arranged concentrically. The inner hollow cylinder 30 encloses the inner conductor 13, such that it is fixed, in the area of one specific refinement, for example in the form of an annular groove 25 with a reduced external diameter. The outer hollow cylinder 29 rests on the inner wall of the through-hole 17' of the insert 14. The two hollow cylinders 29 and 30 are connected to one another by preferably radial webs 34. The preferably radial webs 34 are formed by walls of blind holes 32, 33, which extend into the supporting element 15 between the two hollow cylinders 29, 30, preferably in the axial direction alternately from both sides. In order to allow them to be removed from the mould more easily after being moulded, the blind holes 32, 33 preferably taper towards the base. In the illustrated example, three blind holes, each offset through 120° are provided from each side, although other numbers and arrangements of blind holes are also feasible. In particular, it is also feasible to form all of the blind holes from one side. It is likewise also feasible to provide helical blind holes with corresponding helical webs.

In the area of the slots 26, the insert 14 has an annular bead 37 which is cut through by the slots 26. An annular groove 27 with a reduced diameter is provided behind the annular bead 37. The mould is designed such that the moulded supporting element 15 has a first ring 28 in front of the annular bead 37, and the annular groove 27 is filled by a second ring 36. The two rings 28, 36 are firmly connected to one another and to the outer hollow cylinder 29 by webs 35, which are created by filling the slots 26. The two rings 28, 36 with the annular bead 37 between them fix the supporting element in the axial direction, and the webs 35 fix the supporting element 15 in the circumferential direction.

After the moulding of the supporting element 15, the insert 14, together with the moulded supporting element 15 and the inner conductor 13 held therein are inserted as far as the step 19 into one of the housing parts 12, and the arrangement is then screwed to the other housing part 11.

The supporting element 15 is preferably composed of a liquid-crystal polymer (LCP) which has a relative dielectric constant $\in_r$ of about 3. However, it is likewise also possible to use PTFE, which can be processed thermoplastically, or some other material. The supporting element 15 has an axial length in the region of about 2 to 3 mm for a connecting element 10 whose overall length is more than 7 times greater.

Overall, the invention results in a coaxial connecting element which is suitable for frequencies up to 65 GHz and is distinguished by good electrical and transmission characteristics, with the capability to be produced easily and with good mechanical robustness, at the same time. It is self-evident that numerous modifications are possible within the scope of the invention and on the basis of the exemplary embodiment explained here. In particular, the frequency range can be extended up to 250 GHz or more by adaptation of the dimensions.

The invention claimed is:

1. A coaxial connecting element to be used in a microwave band application comprising:

an inner conductor which extends along an axis and is held concentrically in an outer conductor by means of at least one dielectric supporting element, wherein the outer conductor has a plurality of slots distributed around a circumference thereof in an area of the at least one supporting element, and the supporting element is formed integrally; and wherein the supporting element has two hollow cylinders which are arranged concentrically in one another and are connected to one another by radial webs, with an inner one of the hollow cylinders holding the inner conductor and with an outer one of the hollow cylinders being connected to an insert, and the radial webs are formed by walls of blind holes which extend into the supporting element between the two hollow cylinders in an axial direction and alternately from both sides.

2. The connecting element according to claim 1, wherein the supporting element is molded on the outer conductor.

3. The connecting element according to claim 1, wherein the supporting element is non-detachably connected to the outer conductor.

4. The connecting element according to claim 1, wherein the outer conductor has a housing in which an essentially hollow-cylindrical insert is arranged and held concentrically, the supporting element is formed integrally on the insert, and slots are arranged in the insert.

5. The connecting element according to claim 4, wherein the supporting element fills the slots in the insert in the circumferential direction in order to fix the supporting element to the insert.

6. The connecting element according to claim 4, wherein the insert has an annular groove on an outside surface thereof, and the supporting element fills the annular groove in the axial direction in order to fix the supporting element to the insert.

7. The connecting element according of claim 4, wherein the housing of the outer conductor has two housing parts which are arranged one behind the other in an axial direction, the housing parts are configures to be screwed to one another and hold the insert with the integrally formed supporting element and fix it in the axial direction.

8. The connecting element according to claim 7, wherein an axial through-hole is provided in each of the two housing parts, through which the inner conductor runs, and both axial through-holes have a step on which the insert together with the integrally formed supporting element is supported in the axial direction.

9. The connecting element according to claim 8, wherein the insert has a third through-hole, and internal diameters of the three through-holes are identical.

10. The connecting element according to claim 1, wherein the supporting element is arranged in a center area of the connecting element viewed in an axial direction.

11. The connecting element according to claim 1, wherein the blind holes taper towards a base.

12. The connecting element according to claim 1, wherein the inner conductor has a section in the area of the supporting element which holds the inner hollow cylinder of the supporting element fixing it in the axial direction and/or securing it against rotation about an axis.

13. The connecting element according to claim 4, wherein two or more slots are provided and are distributed uniformly over the circumference of the insert.

14. The connecting element according to claim 1, wherein the supporting element is composed of a liquid-crystal polymer.

15. The connecting element according to claim 1, wherein the supporting element is composed of a thermoplastic PTFE.

16. A method for producing a connecting element according to claim 1, wherein the supporting element is molded onto the outer conductor using an injection-molding method.

17. The method according to claim 16, wherein the outer conductor has a housing in which an essentially hollow cylindrical insert is arranged and held concentrically, the supporting element is molded onto the insert, and the insert, together with the molded-on supporting element, is installed in the housing.

18. The connecting element according to claim 1, wherein the inner conductor is rod-shaped.

* * * * *

UNITED STATES PATENT AND TRADEMARK OFFICE

CERTIFICATE OF CORRECTION

PATENT NO. : 7,811,125 B2
APPLICATION NO. : 12/439953
DATED : October 12, 2010
INVENTOR(S) : Kretz et al.

It is certified that error appears in the above-identified patent and that said Letters Patent is hereby corrected as shown below:

Column 6, line 13, Claim 7, "parts are configures" should read -- parts are configured --

Signed and Sealed this
First Day of February, 2011

David J. Kappos

David J. Kappos
*Director of the United States Patent and Trademark Office*